US005088615A

United States Patent [19]

Neuman

[11] Patent Number: 5,088,615

[45] Date of Patent: Feb. 18, 1992

[54] PAIL HAVING AN IMPROVED BAIL

[75] Inventor: Clayton L. Neuman, Coon Rapids, Minn.

[73] Assignee: Schwan's Sales Enterprises, Inc., Marshall, Minn.

[21] Appl. No.: 525,127

[22] Filed: May 17, 1990

[51] Int. Cl.[5] ..... B65D 25/28

[52] U.S. Cl. ..... 220/95; 220/91; 220/306; 220/659; 206/515; 206/520

[58] Field of Search ..... 220/91, 92, 95, 96, 220/659, 306; 206/515, 518, 519, 520

[56] References Cited

U.S. PATENT DOCUMENTS

| | | | |
|---|---|---|---|
| 1,351,896 | 9/1920 | Doyle | 220/95 |
| 1,543,406 | 6/1925 | Taliferro, Jr. . | |
| 1,575,266 | 3/1926 | Hothersall . | |
| 2,176,711 | 10/1939 | Gorman | 220/91 |
| 3,425,471 | 2/1969 | Yates | 220/91 |
| 3,550,807 | 12/1970 | Yates, Jr. . | |
| 3,915,363 | 10/1975 | Frankenberg . | |
| 4,181,226 | 1/1980 | Weinert . | |
| 4,240,554 | 12/1980 | Bock | 206/515 |
| 4,293,073 | 10/1981 | Yates, Jr. | 206/519 |
| 4,293,080 | 10/1981 | Letica | 220/659 |
| 4,643,325 | 2/1987 | Streit . | |
| 4,813,568 | 3/1989 | Fuehrer . | |
| 4,997,098 | 3/1991 | Buza et al. | 220/91 |
| 4,998,622 | 3/1991 | Drack | 206/519 |

*Primary Examiner*—Stephen Marcus
*Assistant Examiner*—Stephen Cronin
*Attorney, Agent, or Firm*—Merchant, Gould, Smith, Edell, Welter & Schmidt

[57] ABSTRACT

The present invention provides an apparatus for containing goods. A bail member is connected to a pail in such a manner that the pail and the pail member are able to withstand a centrifugally directed impact upon the bail member. A contact portion of the bail member substantially contacts a cross support member of the pail in response to such an impact. Additonally, the pails are designed to be stacked within one another. The structure is such that the bail members do not catch on the ridges or rims of lower pails in the stack.

22 Claims, 2 Drawing Sheets

PAIL HAVING AN IMPROVED BAIL

FIELD OF THE INVENTION

This invention relates to containers, and more specifically, to an improved pail having an improved bail.

BACKGROUND OF THE INVENTION

Containers come in various shapes and sizes in order to suit various needs. Generally speaking, the value of a container is merely a function of what it contains. Since it is typically the contents that are of significance, it is desirable to minimize the cost of containers, while satisfying any requirements regarding ease of use and/or protection of the contents.

One familiar container, which is suitable for ice cream sold in grocery stores, is a plastic pail, which is relatively cheap and effective. Such pails generally include a wire bail that attaches to the pail in order to provide a convenient handle for the container. Although such pails are commonly used, they have certain significant shortcomings.

First, the pails and their contents are subject to potential damage during shipping and handling. There have been cases in which a end of the bail punctured the side of the pail in response to a centrifugally directed impact at or near the end of the bail. Not only does such puncture break the seal of the container, but it also tends to introduce a small piece of plastic into the ice cream. Such a piece of plastic presents a health threat to consumers, particularly small children, who may choke on it.

A second problem with the "conventional" pail arises in connection with stacking the pails within one another, as may be the case for storage or shipping prior to use. The bails tend to catch on the rims and/or ridges of pails stacked beneath them, making it difficult to separate the pails.

The present invention provides an improved pail having an improved bail that satisfies the desired design attributes. For example, the present invention includes structure designed to prevent the ends of the bail from puncturing the sides of the pail. Also, the structure of the present invention is such that a plurality of such pails can be stacked within one another without the possibility of the bails catching on rims and/or ridges of pails stacked beneath them.

While the invention will be described with respect to a preferred embodiment, having a specific configuration, it will be understood that the invention is not limited to such preferred embodiment, but that the general principles of the invention apply to containers in general. Thus, variations of the invention will become apparent to those skilled in the art upon a more detailed description of the invention.

SUMMARY OF THE INVENTION

The present invention provides an apparatus for containing goods, comprising: (a) a vessel; (b) a bail member; (c) means, a first part of which is an integral part of said vessel, and a second part of which is an integral part of said bail member, for connecting said vessel and said bail member; and (d) means, a first part of which is an integral part of said vessel, and a second part of which is an integral part of said bail member, for dispersing impact upon said bail member to said vessel.

According to another embodiment, there is provided an improved bail designed for use with a pail of the type having diametrically opposed cross support members with holes formed therein, comprising: (a) diametrically opposed nubs at each end of the bail and designed to secure the bail to the cross support members; (b) diametrically opposed shaft members joined to said nubs and passing through the holes in the cross support members; (c) diametrically opposed U-shaped members joined to said shaft members and designed to substantially contact the cross support members; (d) diametrically opposed arcuate members joined to said U-shaped members; and (e) a connecting member joining said diametrically opposed arcuate members, wherein said connecting member is designed as a handle for the pail.

BRIEF DESCRIPTION OF THE DRAWINGS

Referring to the Figures, wherein like numerals represent like parts throughout the several views.

DETAILED DESCRIPTION OF THE INVENTION

Figure 1:
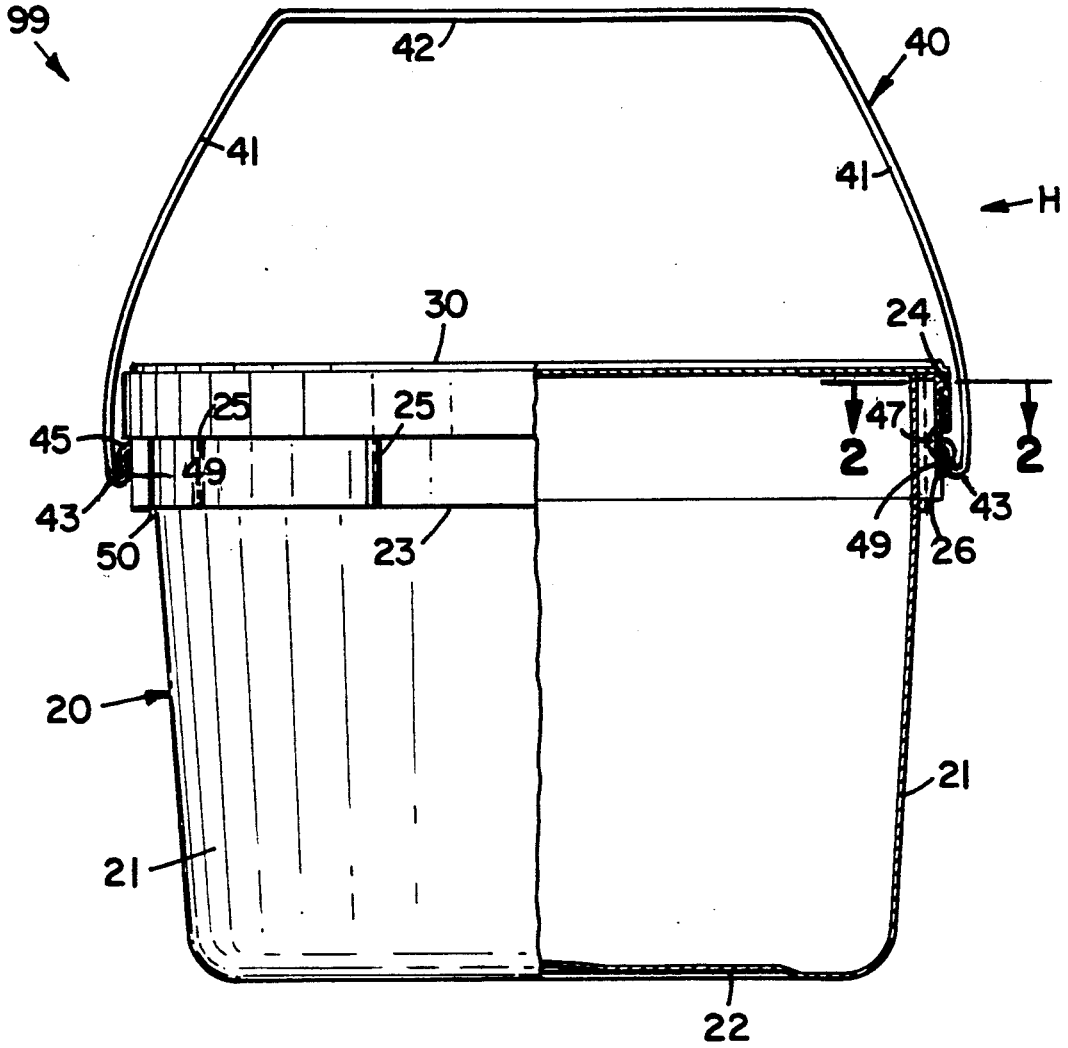
FIG. 1 is a partially sectioned front view of a preferred embodiment of the invention.

Referring to FIG. 1, a preferred embodiment of the present invention is generally designated at 99 and includes a pail 20, a lid 30, and a bail 40. The pail 20 has a cylindrical wall 21 and a bottom 22, which define a containment space therein. The pail 20 also has a circumferential ridge 23 that is an integral part of the cylindrical wall 21 relatively near the top of the pail 20. The very top of the cylindrical wall 21 is integrally connected to a rim 24 that extends somewhat beyond the wall 21 around the circumference of the pail 20. The rim 24 provides structure for resiliently connecting the lid 30 to the pail 20.

Figure 2:
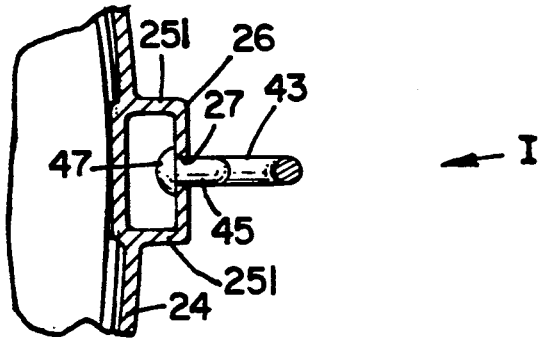
FIG. 2 is a sectioned top view of a portion of the preferred embodiment shown in FIG. 1 (with lid 30 removed)

Rib members 25 extend longitudinally along the cylindrical wall 21 between the rim 24 and the ridge 23. The rib members 25, the rim 24, and the ridge 23 all contribute to the structural integrity of the pail by enhancing the rigidity of the cylindrical wall 21. Referring to FIG. 2, modified rib members 251 support cross support member 26, all of which form integral parts of the pail 20. A corresponding pair of modified rib members and a corresponding cross support member are located on the pail opposite those already identified. The modified rib members 251 are larger than the other rib members 25, both with respect to thickness and depth, as measured from the cylindrical wall 21. The cross support member 26 spans the area between the modified rib members 251 and, in turn, provides support for a bail 40, which attaches through hole 27 formed in the cross support member 26.

The bail 40 includes a handle portion 42, corresponding arcuate portions 41, corresponding U-shaped portions 43, corresponding shaft portions 45, and corresponding nubs 47, all of which form integral parts of the bail 40. The handle portion 42 provides means for handling and/or lifting the pail 20. The nubs 47 snap through the holes 27 to secure the bail 40 to the pail 20.

A problem with known containers of this general type is that a centrifugally directed impact near the end of the bail can cause the end of the bail to puncture the pail. Not only does such puncturing compromise the seal of the pail, but it also tends to introduce a small piece of plastic into the contents of the pail. The small piece of plastic poses a health hazard because a person, and particularly a small child, may choke on it. The structure of the present invention is designed to minimize the possibility of such puncturing.

As already noted, the modified rib members 251 that support the cross support members 26 are larger than the other rib members 25, both in terms of thickness and depth, as measured from the cylindrical wall 21. The extra thickness ensures that the modified rib members can withstand a substantial impact. The extra depth ensures that there is adequate distance between the nub 47 and the cylindrical wall 21, even if the cross support member 26 deflects somewhat in response to a centrifugally directed impact I. Also, the distance, and thus, the area, between the modified rib members 251 is sufficiently small to substantially protect against collapse of the cross support member 26.

Figure 3:
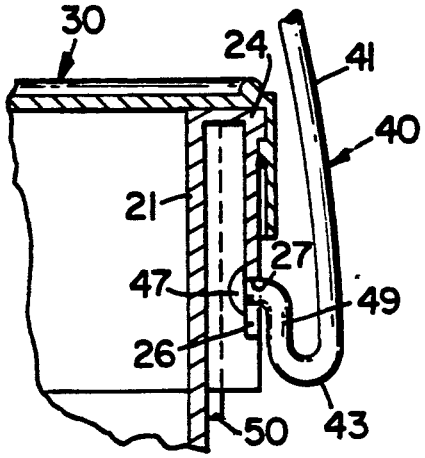
FIG. 3 is an enlarged view of a portion of the preferred embodiment shown in FIG. 1.

Referring to FIG. 3, the U-shaped sections 43 include contact portions 49, which substantially contact the cross support members 26 in response to the impact I. The contact portion 49 distributes the impact I to the cross support member 26, thus, preventing the nub 47 from substantially contacting the cylindrical wall 21. The depth of the modified rib members 251 is greater than the effective length of the shaft portions 45. Thus, contact between the contact portions 49 and the cross support members 26 prevents the nubs 47 from substantially contacting the cylindrical wall 21. Additionally, the U-shaped sections 43 absorb shock directly to the extent that they resist deformation in response to the impact I.

Figure 4:
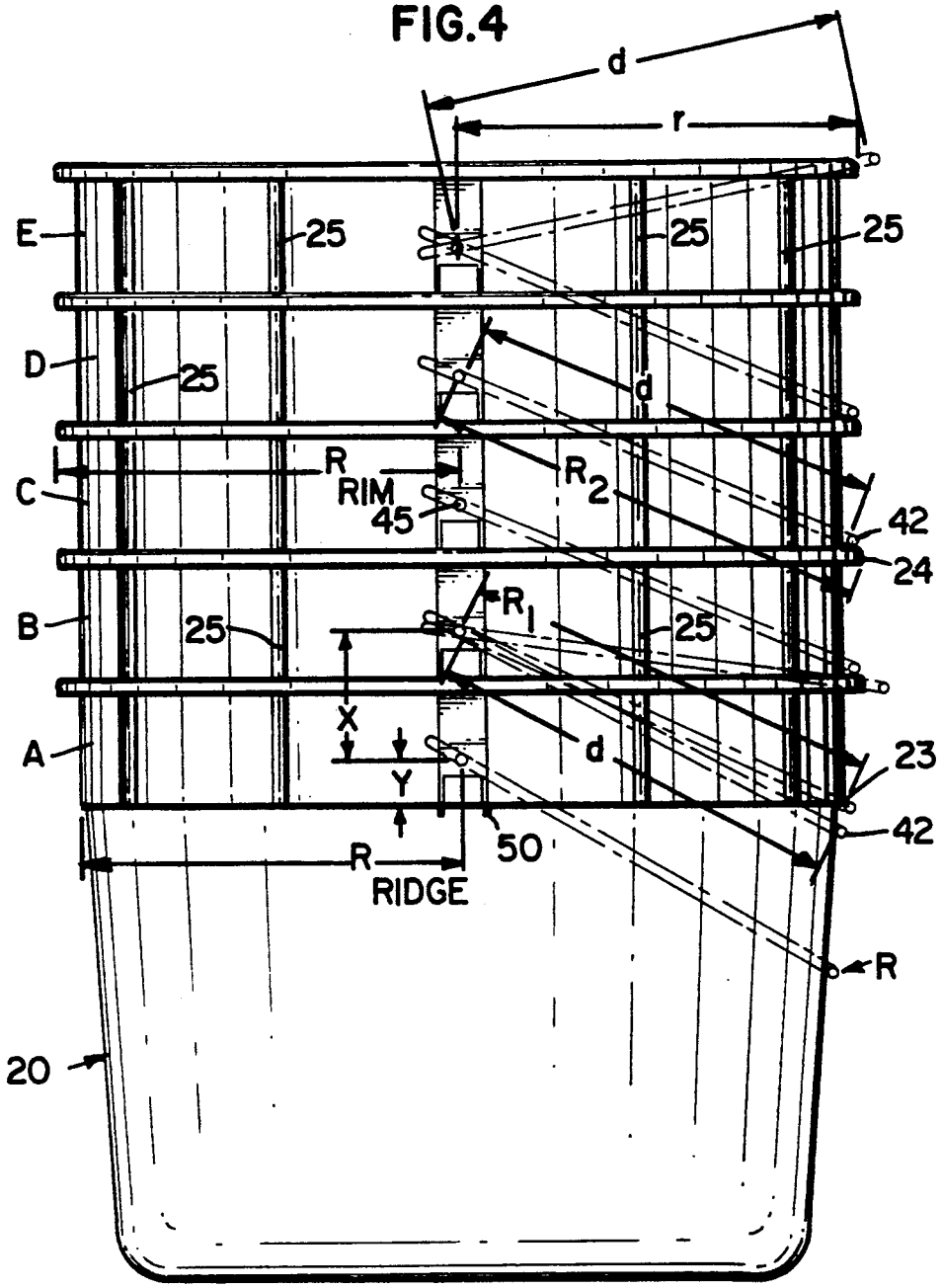
FIG. 4 is a side view of a nested stack of a plurality of the preferred embodiment shown in FIG. 1.

A second problem with known containers of this general type arises in connection with stacking the containers within one another. The handle portion tends to catch on the rims of the pails beneath it, making it difficult to handle the pails efficiently. As shown in FIG. 4, the structure of the present invention is designed to avoid this problem. A stack of nested pails A–E are shown in FIG. 4 with the cross support members aligned relative to one another. Tabs 50 (shown only on pail A) engage recesses 51 (shown in FIG. 2) to maintain the pails in alignment.

In order for the bail 40 to move between a handling position H, as shown in FIG. 1, and a rest position R as shown in FIG. 4, the distance d between the handle portion 42 and a line defined by the shaft portions 45 must be greater than the radius r of the rim 24, as shown in FIG. 4. In order to ensure that the handle portion does not catch on the ridge or rim of a pail stacked beneath it, a definite relationship must exist between the radius of the rim, the radius of the ridge, the location of the holes relative to the ridge the location of the ridge relative to the rim, and the effective radial length, which defines the path of movement of the handle portion, of the bail.

As shown in FIG. 4, the present invention is designed in such a manner that when several pails according to the present invention are stacked within one another, the handle portion 42 of one pail rests safely above the rim 24 of the pail beneath it, and the handle portion 42 of the next to bottom pail rests safely below the ridge 23 of the bottom pail. Referring first to pails A and B, the effective radial length d is greater than the distance $R_1$ between the shaft portions 45 (one not shown) of pail B and the ridge 23 of pail A. Thus, the handle portion 42 of pail B rests freely below the ridge 23 of pail A. The distance $R_1$ between the shaft portions 45 (one not shown) of pail B and the ridge 23 of pail A is controlled by the following equation:

$$R_1=((X+Y)^2+(R_{RIDGE})^2)^{\frac{1}{2}}$$

where $R_1$ denotes the distance between the shaft portions of one pail and the outer surface of the ridge of a pail stacked directly beneath it;

X denotes the distance between the rim and the ridge on a given pail;

Y denotes the distance between the holes and the ridge on a given pail; and $R_{RIDGE}$ denotes the outer radius of the ridge on a given pail.

Accordingly, the effective radial length d of the bail must be greater than the distance R between the shaft portions of one pail and the outer portion of the ridge of a pail stacked directly beneath it.

Referring to pails B, C, and D in FIG. 4, the effective radial length d is less than the distance $R_2$ between the shaft portions 45 (one not shown) of pail D and the rim 24 of pail B. Thus, the handle portion 42 of pail D rests freely above the rim 24 of pail B. The distance $R_2$ between the shaft portions 45 (one not shown) of pail D and the rim 24 of pail B is controlled by the following equation:

$$R_2=((X+Y)^2+(R_{RIM})^2)^{\frac{1}{2}}$$

where $R_2$ denotes the distance between the shaft portions of one pail and the outer surface of the rim of a pail stacked two beneath it;

X denotes the distance between the rim and the ridge on a given pail;

Y denotes the distance between the holes and the ridge on a given pail; and $R_{RIM}$ denotes the outer radius of the rim of a given pail.

Accordingly, the effective radial length d of the bail must be less than the distance $R_2$ between the shaft portions of one pail and the outer portion of the rim of a pail stacked two beneath it.

Additionally, the arcuate portions 41 must be configured in such a manner that they do not interfere with the ridges and/or the rims of pails stacked beneath them as the bail is moved between the handling position and the rest position. Thus, the arcuate portions 41 must establish the desired effective radial length d and also, have a radius of curvature not significantly less than the outer radius of the rim. Since the effective radial length d is greater than the distance $R_1$ but less than the distance $R_2$, the trace of the bail, as it moves between the rest position and the handling position, circumnavigates the ridge of a pail stacked directly beneath it but contacts the rim of a pail stacked two beneath it.

While a specific embodiment of the present invention has been disclosed, it is to be understood that such disclosure has been merely for the purpose of illustration and that the invention is not to be limited in any manner thereby. Various modifications of this invention will be apparent to those skilled in the art in view of the foregoing example. The scope of the invention is to be limited only by the appended claims.

What is claimed is:

1. An apparatus for containing goods, comprising:
(a) a container having a center;
(b) a bail member;
(c) connecting means, a first part of which is an integral part of said container, and a second part of which is an integral part of said bail member, for connecting said container and said bail member;
(d) impact dispersing means, a first part of which is an integral part of said container, and a second part of which is an integral part of said bail member, for dispersing impact upon said bail member to said container; and
(e) impact absorbing means, forming an integral part of said bail member, for absorbing impact upon said bail member directed approximately toward said center of said container wherein said impact absorbing means includes U-shaped members of said bail member which are arranged and configured external of said first part of said impact dispersing means.

2. An apparatus according to claim 1, wherein said impact absorbing means includes cross support members on said container, said cross support members have outer contact surfaces, and said U-shaped members are proximate said outer surfaces of said cross support members, are coplanar, and are coincidentally oriented relative to one another.

3. An apparatus according to claim 1, wherein said impact dispersing means includes cross support members on said container having outer contact surfaces, and portions of said bail member span said outer contact surfaces of said cross support members when said bail member is in a rest position.

4. An apparatus according to claim 3, wherein said connecting means includes holes in said cross support members and nubs on said bail member, wherein said nubs and said contact portions are integrally connected by shaft portions of said bail member that pass through said holes.

5. An apparatus according to claim 4, wherein said container includes a rim having a rim radius, a ridge having a ridge radius, and rib members extending between said rim and said ridge, whereby said rim, said ridge, and said rib members make said container sturdier.

6. An apparatus according to claim 5, wherein said container has an inside and an outside, and said shaft portions are of such a length that said nubs are away from said outside of said container when said contact portions are in contact with said cross support members, whereby said contact portions substantially contact said cross support members in response to any impact upon said bail member that tends to force said nubs toward said outside of said container, and said nubs are prevented from substantially contacting said outside of said container.

7. An apparatus according to claim 6, wherein substantially diametrically opposed pairs of said rib members support said cross support members, and said pairs extend a distance from said outside of said container such that said nubs are away from said outside of said container when said contact portions are in contact with said cross support members, whereby said contact portions substantially contact said cross support members in response to any impact upon said bail member that tends to force said nubs toward said outside of said container, and said nubs are prevented from substantially contacting said outside of said container.

8. A stack of at least two apparatus according to claim 5, wherein said rim of a lowermost apparatus substantially contacts said ridge of next apparatus, and said ridge of any given apparatus is positioned at a first distance from said rim of said given apparatus, and said holes of said given apparatus are positioned at a second distance from said ridge of said given apparatus, and said holes of said next apparatus are positioned at a third distance from said ridge of said lowermost apparatus, whereby said third distance is equal to said first distance plus said second distance.

9. A stack of at least two apparatus according to claim 8, wherein said bail member of said given apparatus moves along a curved path having a path radius between a rest position and a handling position, and the square of said path radius is greater than the sum of the squares of said third distance and said ridge radius, whereby said bail member of said next apparatus circumnavigates said ridge of said lowermost apparatus as said bail member moves between said rest position and said handling position.

10. A stack of at least three apparatus according to claim 9, including an upper apparatus, wherein the square of said path radius is less than the sum of the squares of said third distance and said rim radius, whereby said rim of said lowermost apparatus blocks said path as said upper apparatus moves from said handling position toward said rest position, thereby establishing a stacked rest position.

11. A pail, comprising:
(a) an open-ended cylindrical container, defining a containment space therein;
(b) a lid, removably attachable to said container;
(c) a bail, having two ends that are connected to said container at diametrically opposed locations; and
(d) cross support members, integrally joined to said container by at least two rib members, external to said containment space and proximate said diametrically opposed locations, for substantially retaining said ends of said bail, wherein portions of said bail span said cross support members and said at least two rib members when said bail is in a rest position, wherein said portions of said bail substantially contact said cross support members in response to an impact upon said bail, whereby said ends of said bail do not substantially contact said container in response to said impact.

12. A pail according to claim 11, wherein said ends of said bail include nubs, and said nubs are integrally joined by shaft members to contact portions proximate said cross support members which pass through holes formed in said cross support members.

13. A pail according to claim 12, wherein said container includes a rim, a ridge, and a plurality of rib members extending therebetween, whereby said rim, said ridge, and said rib members make said container sturdier.

14. A pail according to claim 13, wherein a pair of modified rib members is located proximate each of the diametrically opposed locations, and said modified rib members integrally join said cross support members to said container.

15. A pail according to claim 14, wherein said contact portions are nearer to said nubs than said cross support members are to said container, whereby said contact portions substantially contact said cross support members in response to an impact upon said bail, and said nubs do not substantially contact said container in response to said impact.

16. A pail according to claim 15, wherein a plurality of said pails are stackable within one another, and said bails are moveable through an arcuate path between said rest position and a handling position.

17. A first pail and a second pail, each according to claim 16, wherein said second pail is stacked within said first pail, and an effective handle length separates a handle portion of said bail of said second pail and an axis of rotation of said bail of said second pail, and a distance separates said holes of said second pail and an outer surface of said ridge of said first pail, and said effective handle length is greater than said distance, whereby said arcuate path of said bail of said second pail circumnavigates said ridge of said first pail.

18. A first pail, a second pail, and a third pail, each according to claim 16, wherein said second pail is stacked within said first pail, and said third pail is stacked within said second pail, and an effective handle length separates a handle portion of said bail of said third pail and an axis of rotation of said bail of said third pail, and a distance separates said holes of said third pail and an outer surface of said rim of said first pail, and said effective handle length is less than said distance, whereby said arcuate path of said bail of said third pail passes within said rim of said first pail.

19. A bail designed for use with a pail of the type having diametrically opposed cross support members with diametrically opposed holes formed therein, comprising:

(a) diametrically opposed nubs at each end of the bail, which are designed to secure the bail relative to the cross support members;

(b) diametrically opposed shaft members integrally joined to said nubs and passing through the holes in the cross support members;

(c) diametrically opposed U-shaped members integrally joined to said shaft members, wherein each of said U-shaped members has an inner leg and an outer leg integrally joined by a central lateral member, and said inner legs substantially contact the cross support members, and wherein said U-shaped members are located external of the cross support members, whereby said U-shaped members tend to absorb an impact on the bail which is directed toward the pail;

(d) diametrically opposed arcuate members integrally joined to said U-shaped members, wherein each of said outer legs is an integral extension of each of said arcuate members; and (e) a handle portion integrally joining said diametrically opposed arcuate members, wherein said handle portion is designed as a handle for the pail.

20. A bail according to claim 19, wherein said U-shaped members are designed to collapse in order to absorb an impact upon said outer legs.

21. A bail according to claim 20, wherein portions of the bail extend entirely across the cross support members when the bail is in a rest position, whereby any impact upon said outer legs that is not absorbed by said U-shaped members will be dispersed over the span of the cross support members.

22. A bail according to claim 21, wherein said shaft members and the cross support members are configured in such a manner that said inner legs substantially contact the cross support members in response to an impact upon said outer legs, wherein the force of said impact is dispersed, and whereby said nubs do not substantially contact the pail in response to said impact.

* * * * *

UNITED STATES PATENT AND TRADEMARK OFFICE

CERTIFICATE OF CORRECTION

PATENT NO. : 5,088,615

DATED : February 18, 1992

INVENTOR(S) : Clayton L. Neuman

It is certified that error appears in the above-identified patent and that said Letters Patent is hereby corrected as shown below:

On the title page, In the Abstract:

third line, please delete "pail" and substitute therefore --bail--.

In column 1, line 25, please delete "a" and substitute therefore --an--.

In column 4, line 20, please delete "R" and substitute therefore --$R_1$--.

Signed and Sealed this

Twenty-ninth Day of June, 1993

*Attest:*

*Attesting Officer*

Michael K. Kirk

MICHAEL K. KIRK

*Acting Commissioner of Patents and Trademarks*